US008651000B2

(12) United States Patent
Weber

(10) Patent No.: US 8,651,000 B2
(45) Date of Patent: Feb. 18, 2014

(54) CUTTING DEVICE

(75) Inventor: Günther Weber, Groβ Nemerow (DE)

(73) Assignee: Weber Maschinenbau GmbH Breidenbach, Breidenbach (DE)

( * ) Notice: Subject to any disclaimer, the term of this patent is extended or adjusted under 35 U.S.C. 154(b) by 141 days.

(21) Appl. No.: 13/254,620

(22) PCT Filed: Feb. 11, 2010

(86) PCT No.: PCT/EP2010/000851
§ 371 (c)(1),
(2), (4) Date: Nov. 14, 2011

(87) PCT Pub. No.: WO2010/099857
PCT Pub. Date: Sep. 10, 2010

(65) Prior Publication Data

US 2012/0055306 A1 Mar. 8, 2012

(30) Foreign Application Priority Data

Mar. 3, 2009 (DE) ..... 10 2009 011 398

(51) Int. Cl.
*B26D 5/20* (2006.01)

(52) U.S. Cl.
USPC ..... 83/216; 83/355; 83/397

(58) Field of Classification Search
USPC ..... 83/225, 493, 350–357, 478, 397–397.1; 99/543
See application file for complete search history.

(56) References Cited

U.S. PATENT DOCUMENTS

| | | | | | |
|---|---|---|---|---|---|
| 2,479,182 | A * | 8/1949 | Peters | 83/91 |
| 3,353,430 | A * | 11/1967 | Brackmann Warren et al. | 83/13 |
| 4,070,941 | A * | 1/1978 | Lorenz | 83/478 |
| 4,843,932 | A * | 7/1989 | Weber et al. | 83/490 |
| 5,074,179 | A * | 12/1991 | Omi | 83/478 |
| 6,591,723 | B1 * | 7/2003 | Jung | 83/116 |
| 2003/0037653 | A1 * | 2/2003 | Betti et al. | 83/174 |
| 2008/0250945 | A1 * | 10/2008 | Seager | 99/537 |
| 2013/0074700 | A1 * | 3/2013 | Cheung | 99/348 |

FOREIGN PATENT DOCUMENTS

| | | | |
|---|---|---|---|
| DE | 86577 | | 11/1970 |
| DE | 10 2005 062501 | A1 | 6/2007 |
| EP | 0169 399 | A2 | 1/1986 |
| EP | 0 202 777 | A2 | 11/1986 |
| EP | 0 955 137 | A2 | 11/1999 |
| EP | 0 974 432 | A1 | 1/2000 |
| GB | 369 091 | A | 3/1932 |

OTHER PUBLICATIONS

International Preliminary Report on Patentability dated Sep. 15, 2011 for PCT Patent Application PCT/EP2010/000851, 8 pages.
German Search Report dated Feb. 8, 2010 for German Patent Application No. 10 2009 011 398.3, with English language translation, 9 pages.

* cited by examiner

*Primary Examiner* — Sean Michalski

(57) ABSTRACT

The invention relates to a cutting device for slicing food products, comprising a driven circular blade rotating about a blade axis revolving on a track about a center axis, and a cover element rotatable relative to the circular blade on the side of the circular blade facing away from a product to be sliced. A holding device is provided that is designed for counteracting the self-rotation of the cover element about the blade axis.

20 Claims, 4 Drawing Sheets

CUTTING DEVICE

CROSS-REFERENCE TO RELATED APPLICATIONS

This is a national stage application of International Application No. PCT/EP2010/000851, filed Feb. 11, 2010, entitled "Cutting Device," and claims priority to German Patent Application No. DE 10 2009 011 398.3, filed Mar. 3, 2009, both of which are fully incorporated herein by reference.

The present invention relates to a cutting apparatus for slicing food products, in particular to a high-performance slicer, having a drivable circular blade which rotates about a blade axis which revolves on an orbit about a center axis and having a cover element provided at the side of the circular blade remote from a product to be sliced and rotatable relative to the circular blade.

The cover element in such cutting apparatus serves to prevent a disturbing adhesion of cut-off product slices to the circular blade. The product slices come into contact with the cover element and are scraped off thereat. Relatively soft food products can thus also be sliced at a high cutting rate in this manner. A cutting apparatus having a cover element is described in EP 0 169 399 B1, for example.

The cover element, which can be provided, for example, as a disk coaxial with the circular blade, tends toward a self rotation about the blade axis during the operation of the cutting apparatus. A self rotation of the cover element can have unfavorable effects since there is the risk that cut-off product slices are taken along by the rotating cover disk and are hurled away in an uncontrolled manner.

It is therefore an object of the invention to improve cutting apparatus of the named kind with respect to the product slice placement.

The object is satisfied by a cutting apparatus having the features of claim 1. In accordance with the invention, a holding apparatus is provided which is designed to counter a self rotation of the cover element about the blade axis, in particular to prevent a self rotation of the cover element about the blade axis. It can be achieved by the holding apparatus that the cover element is not taken along by the rotational movement of the circular blade, but is rather stationary or only carries out relatively slight self rotational movements. It is thereby achieved that the product slices cut off by the rotating circular blade are reliably scraped off at the cover disk. An exact and reproducible placement position of the product slices can be achieved by this orderly scraping off. Food products which are soft and difficult to slice can also in particular be reliably processed.

Further developments of the invention are set forth in the dependent claims, in the description and in the drawing.

The holding apparatus can in particular be designed to hold the cover element firmly. A separate drive for the cover element is therefore not necessary; it is rather sufficient to fix it with respect to the environment by simple measures.

The holding apparatus preferably cooperates with the side of the cover element remote from the circular blade. The cover element is easily accessible from this side and can be held at a suitable engagement point.

The holding apparatus can couple the cover element with a fixed element, in particular with a frame or with a housing of the cutting apparatus. The cover element is therefore fixed at a component fixed with respect to the frame so that a secure standstill is ensured.

In accordance with an embodiment, the holding apparatus includes an articulated arm arrangement. Since the cover element is always in communication with the circular blade, it runs about the center axis during the operation of the cutting apparatus. An articulated arm arrangement makes it possible to fix the cover element to a component fixed with respect to the frame despite this revolutionary movement.

In accordance with a preferred embodiment, the articulated arm arrangement includes a first articulated arm and a second articulated arm which are movable relative to one another, in particular pivotable relative to one another about a pivot axis extending parallel to the blade axis. The second articulated arm can in this respect be pivotally connected to the fixed element and the first articulated arm can be rotationally fixedly connected to the cover element. The first articulated arm thus holds the cover element firmly with respect to the environment, whereas the second articulated arm serves for the connection of the first articulated arm to the fixed element. The variable spacing of the revolving cover element from the fixed element can be equalized by the pivotability of the articulated arms.

The first articulated arm is preferably connected to the cover element at two mutually spaced apart points. It is ensured in this manner that the cover element is reliably held firmly by the articulated arm and that no rotation of the articulated arm relative to the cover element is possible about the blade axis even under a larger load.

The first articulated arm can have two limbs which, starting from the second articulated arm, run apart and are in particular at an acute angle relative to one another, with the one end of said limbs being connected to the cover element in each case. The first articulated arm can, for example, be a V-shaped component having an apical section and two free-standing ends. The apical section can be pivotally connected to the second articulated arm, while the free-standing ends can be connected to the cover element. Such a component can be made light and nevertheless stable.

The articulated arm arrangement preferably defines pivotal connection points which are substantially in a plane extending parallel to a cutting plane of the circular blade. The articulated arms thus move in a common plane during the cutting movement and do not require any additional construction space along the blade axis. Due to the revolutionary movement of the circular blade and of the cover element in communication with it, slight oscillation movements of the cover plate can occur with respect to the environment in such a configuration; however, they are not critical with respect to the placement of the product slices.

In accordance with an alternative or additional embodiment, the holding apparatus includes a torsionally stiff coupling bar. Such a coupling bar can in particular be led from the side directly toward the cover element and can be fastened thereto. This variant is characterized by great simplicity.

The coupling bar is preferably of variable length in order also to ensure a permanent coupling of the cover element and a fixed element when the coupling bar is fastened to the fixed element to the side of the center axis and thus the spacing between the two fastening points of the coupling bar varies during the revolutionary movement of the cover element. The spacing variation is compensated by the length variability of the coupling bar.

The coupling bar can be rotationally fixedly in engagement with the cover element and with the fixed element by means of two connection joints. Any self rotation of the cover element about the blade axis can be prevented in this variant, that is in particular also the above-mentioned slight oscillation movements.

In accordance with a further development, the coupling bar can be rotatingly drivable about its longitudinal axis to bring about a rotation of the cover element at any desired speed. An adjustable rotation of the cover element relative to the circular blade about the blade axis can be sensible depending on the application in order, for example, to directly influence the positioning of the product to be sliced.

The cover element preferably includes a disk which is coaxial to the circular blade and which extends radially up to the region of the cutting edge of the circular blade. The cut-off product slices thus come largely fully into contact with the cover element, whereby a reliable scraping off is made possible without adhesion problems at the circular blade.

The cover element is preferably supported on the circular blade. No separate drive is thus required for the revolutionary movement of the cover element following the circular blade.

The cover element is preferably provided with elevated portions at the side remote from the circular blade. Such elevated portions can further improve the placement of product slices since an unwanted adhesion to the stationary cover element is prevented.

The invention will be described in the following by way of example with reference to the drawings.

Figure 1:
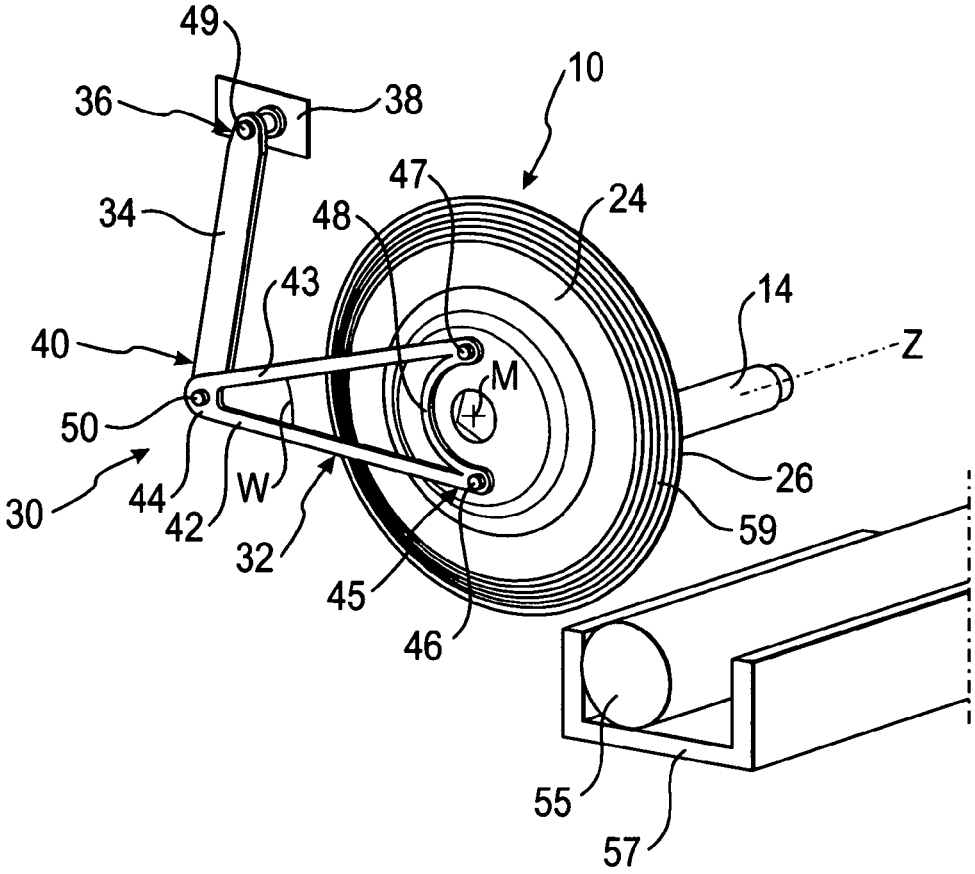
FIG. 1 is a part representation of a cutting apparatus having a revolving circular blade in accordance with a first embodiment of the invention.

In accordance with FIG. 1, a disk-shaped circular blade 10 is rotatably supported and is connected to a drive, not shown, which is able to drive the circular blade 10 rotatingly about a blade axis M. An eccentric arm 14 furthermore has the effect that the circular blade 10 revolves in a planetary motion on a circular orbit about a center axis Z. It is possible to provide a common drive motor for the rotational movement about the blade axis M and for the revolutionary movement about the center axis Z. It is alternatively also possible to provide a separate drive motor for each axis M, Z.

A cover element 24 is supported coaxially to the circular blade 10 and is here formed as a cover disk arched in a hood-like or plate-like manner. The cover disk 24 is rotatable relative to the circular blade 10 about the blade axis M and extends radially up to and into the region of the cutting edge 26 of the circular blade 10. A side of the circular blade 10 is thus almost completely fully covered by the cover element 24.

To prevent a self rotation of the cover plate 24 about the blade axis M, a holding apparatus is provided which is formed in the embodiment in accordance with FIG. 1 as an articulated arm arrangement 30. The articulated arm arrangement 30 includes a first articulated arm 32 and a second articulated arm 34 which are pivotable relative to one another about a pivot axis extending parallel to the blade axis M. A first end 36 of the second articulated arm 34 is pivotally connected to a frame 38 of the cutting apparatus, only shown schematically, and a second end 40 of the second articulated arm 34 is pivotally connected to the first articulated arm 32. The first articulated arm 32 has two limbs 42 and 43 which are connected to one another at an apical section 44 and, starting from this, run apart at an acute angle W. The second end 40 of the second articulated arm 34 is pivotally connected to the apical section 14. Both limbs 42, 43 are fixedly connected, for example screwed or riveted, to the cover disk 24 at an end section 45 of the first articulated arm 32 opposite to the apical section 44. The corresponding fastening points 46, 47 are to the side of the blade axis M. To stabilize the first articulated arm 32, a connection crosspiece 48 curved in a semicircular manner is furthermore provided which extends about the blade axis M and which connects the two limbs 42, 43 to one another at the end section 45. The pivotal connection points 49, 50 defined by the articulated arm arrangement 30 and the fastening points 46, 47 at the cover disk 24 are in a common plane which extends parallel to the cutting plane of the circular blade 10 and only slightly offset therefrom. During the revolutionary movement of the circular blade 10, the pivotal connection points 49, 50 and the fastening points 46, 47 are always in the common plane.

Figure 2A:
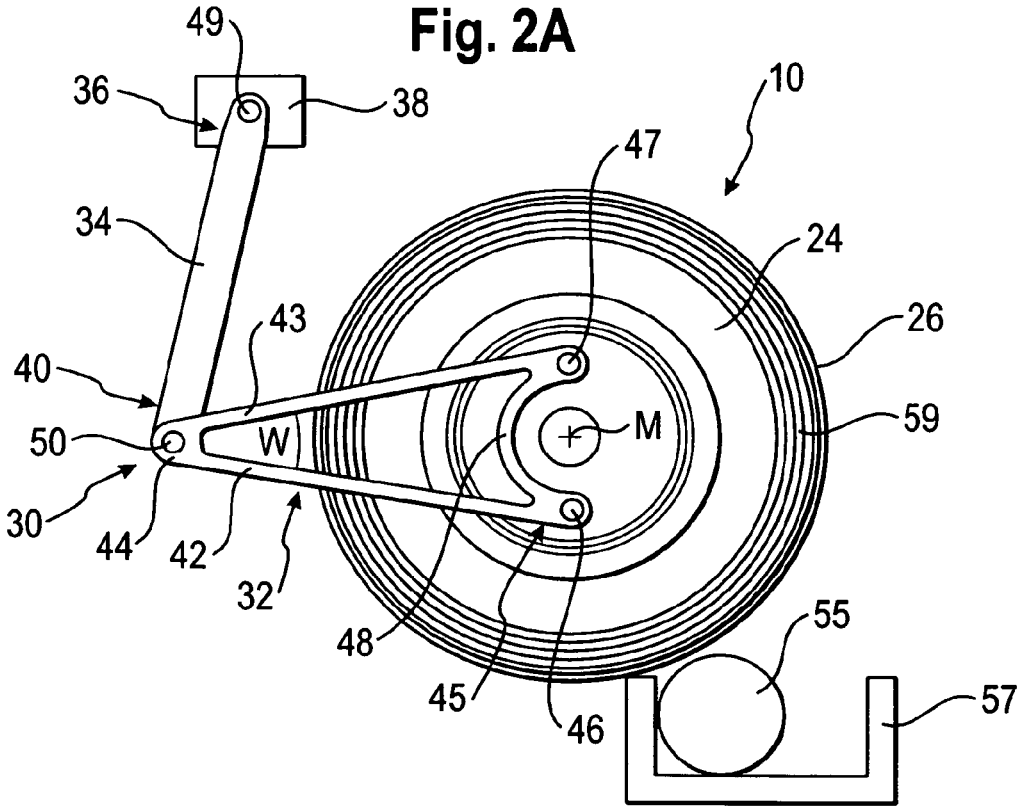
FIG. 2A is a front view of the cutting apparatus in accordance with FIG. 1 in which the circular blade is in a first position.
Figure 2B:
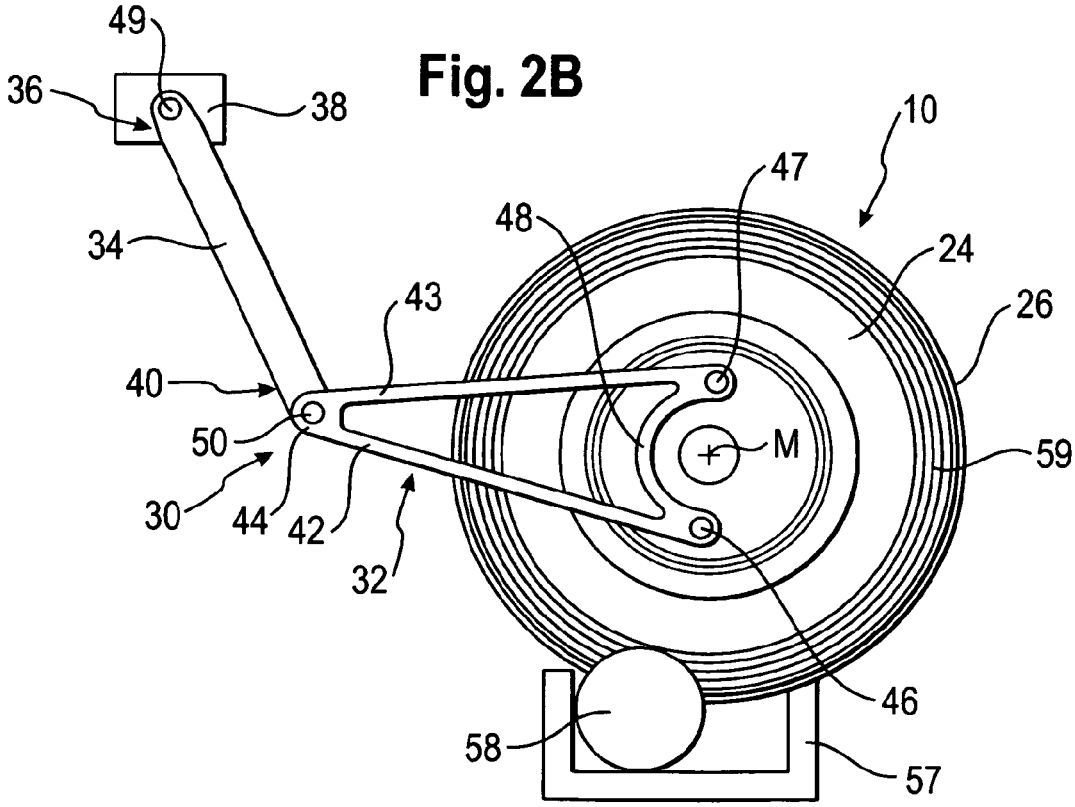
FIG. 2B is a front view of the cutting apparatus in accordance with FIG. 1 in which the circular blade is in a second position.

During the operation of the cutting apparatus, the circular blade 10 on its revolutionary orbit approaches, as is shown in FIG. 2A, a product bar 55 to be sliced which is on a product feed 11 and is automatically advanced by means of a controlled drive, not shown. In the further course of the planetary revolutionary movement, the cutting edge 26 of the circular blade 10 in accordance with FIG. 2B cuts a product slice 58 from the product bar 55. The cover disk 24 provides that the cut-off product slice 58 does not adhere to the circular blade 10, but is rather scraped off at the surface of the cover disk 24. The convex arch of the cover disk 24 supports the controlled scraping off of the product slice 58. Peripheral elevated portions 59 at the surface of the cover disk 24 are provided for the further improvement of the scraping off process.

The cover disk 24 is fixed to the frame 38 by the articulated arm arrangement 30. The varying spacing between the cover disk 24 revolving with the circular blade 10 and the frame 38 is in this respect compensated by the pivot movement of the two articulated arms 32, 34, as can also be recognized in FIGS. 2A and 2B. A slight, oscillating rotation of the cover disk 24 about the blade axis M results during the revolutionary movement due to the changing angular position of the two articulated arms 32, 34. This oscillation movement, however, only has an extremely slight stroke and is therefore not detrimental to an exact product slice placement. The cut-off product slice 58 falls in an exact position from the cover disk 24 and can be further processed in any desired manner, in particular supplied to an automatic placement line, transport line and/or packaging line.

Figure 3:
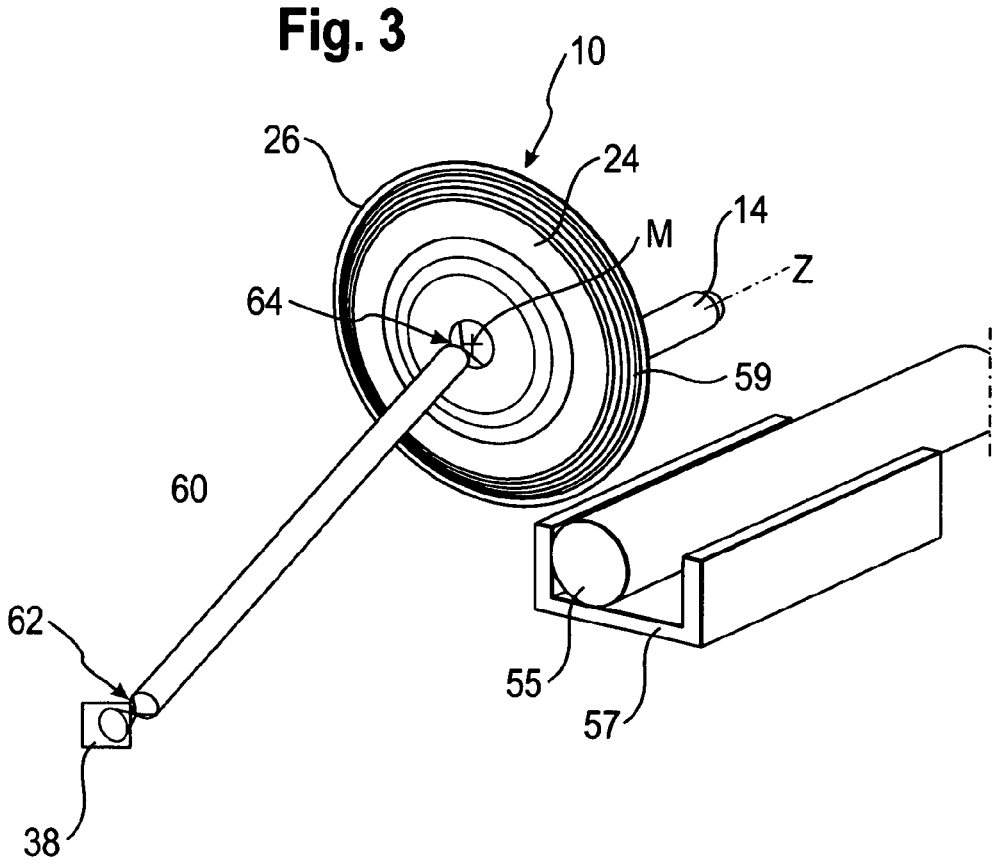
FIG. 3 is a part representation of a cutting apparatus having a revolving circular blade in accordance with a second embodiment of the invention.
Figure 4A:
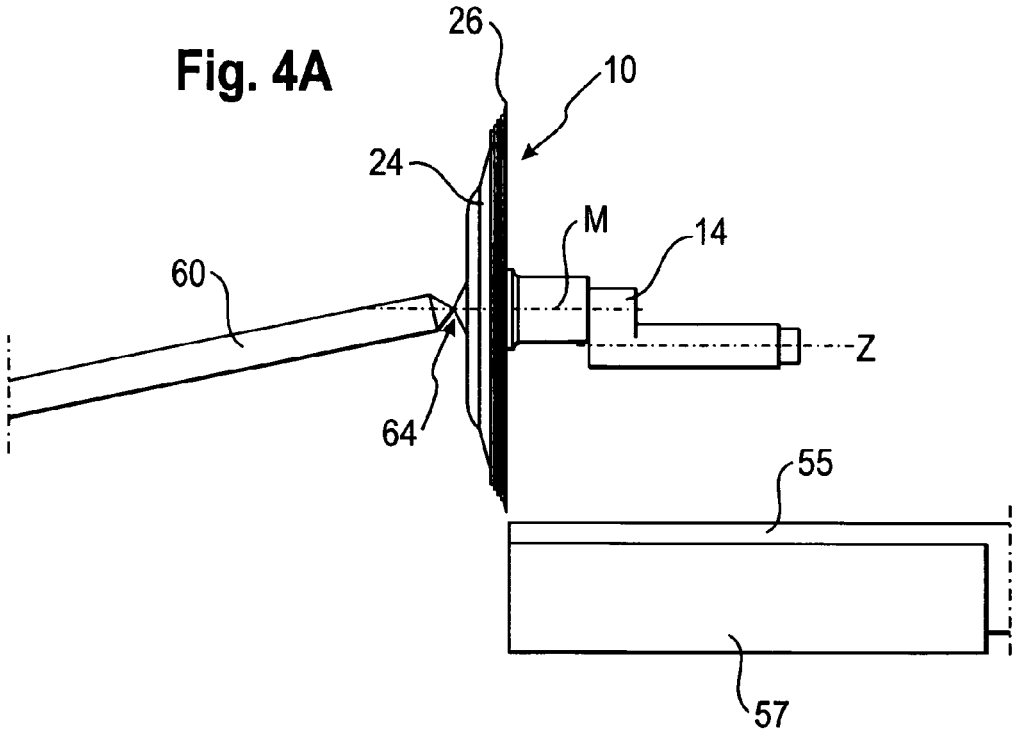
FIG. 4A is a side view of the cutting apparatus in accordance with FIG. 3 in which the circular blade is in a first position.
Figure 4B:
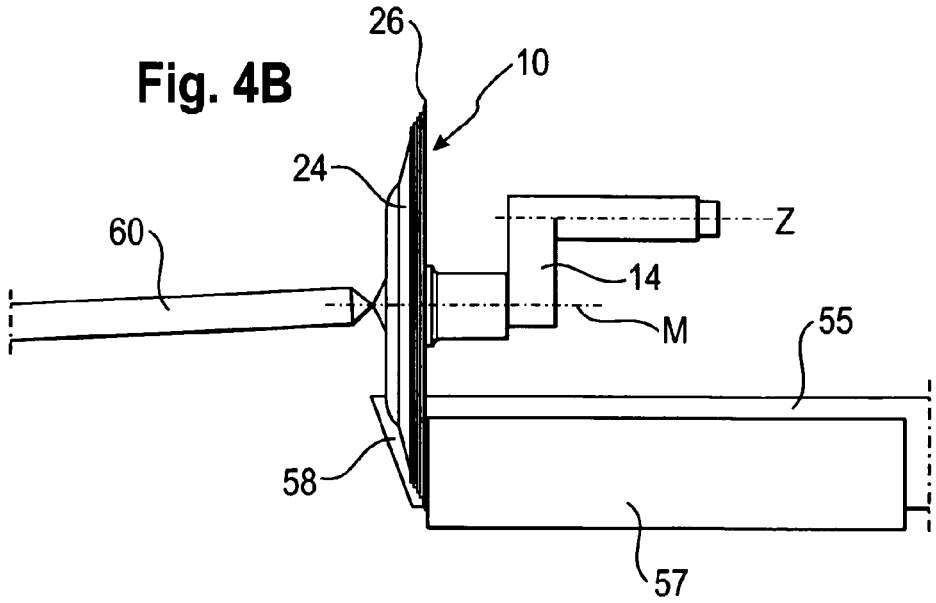
FIG. 4B is a side view of the cutting apparatus in accordance with FIG. 3 in which the circular blade is in a second position.

In FIG. 3, a cutting apparatus in accordance with a second embodiment of the invention is shown, with equivalent components being designated by the same reference numerals as in the first embodiment. The holding apparatus for holding the cover plate 24 firmly is here made as a torsionally stiff and length variable coupling bar 60. The coupling bar 60 is rotationally fixedly in engagement with the cover disk 24 and with the frame 38 of the cutting apparatus by means of two connection joints 62, 64. Since the connection joints 62, 64 are made with rotational stiffness, the cover disk 24 cannot rotate with the circular blade 10, but remains stationary during the revolutionary movement. The coupling bar 50 engages in the region of the blade axis M at the cover element 24 and describes a conical surface during the revolutionary movement of the cover element 24, as can also be seen from FIGS. 4A and 4B.

An advantage of the cutting apparatus in accordance with the second embodiment is that, if required, a drive can be provided for the coupling bar 60 to allow a direct rotation of the cover disk 24 in a predefined direction and at a defined speed. A defined relative rotation between the circular blade 10 and the cover disk 24 can be brought about using such a drive. Such a relative rotation can be used for the direct influencing of the placement behavior of the cutting apparatus. The braking effect exerted by the cover disk 24 on the cut-off product slice 58 on each cut can be directly preset by the selection of the speed of the relative rotation so that a particularly exact placement of the respective product slice 58 is possible.

Overall, a substantial improvement in the placement behavior of the associated cutting apparatus can be achieved by the principle of the holding firm of the cover disk 34. In particular soft food products which are otherwise difficult to cut can thus be sliced without problem.

REFERENCE NUMERAL LIST

10 circular blade
14 eccentric arm
24 cover disk
26 cutting edge
30 articulated arm arrangement
32 first articulated arm
34 second articulated arm
36 first end
38 frame
40 second end
42 limb
43 limb
44 apical section
45 end section
46 fastening point
47 fastening point
48 connection crosspiece
49 pivotal connection point
50 pivotal connection point
55 product bar
57 product feed
58 product slice
59 elevated portion
60 coupling bar
62 connection joint
64 connection joint
M blade axis
Z center axis
W angle

The invention claimed is:

1. A cutting apparatus for slicing food products, comprising:

a drivable circular blade (10) which rotates about a blade axis (M) which revolves on an orbit about a center axis (Z);

a cover element (24) provided at a side of the circular blade (10) remote from a product (55) to be sliced and rotatable relative to the circular blade (10); and a holding apparatus that prevents rotation of the cover element in response to rotation of the circular blade.

2. An apparatus in accordance with claim 1, wherein the holding apparatus (50, 60) is designed to hold the cover element (24) firmly.

3. An apparatus in accordance with claim 1, wherein the holding apparatus (30, 60) cooperates with the side of the cover element (24) remote from the circular blade (10).

4. An apparatus in accordance with claim 1, wherein the holding apparatus (30, 60) couples the cover element (24) with a fixed element (38).

5. An apparatus in accordance with claim 4, wherein said fixed element (38) is a frame or a housing of the cutting apparatus.

6. An apparatus in accordance with claim 1, wherein the holding apparatus includes an articulated arm arrangement (30).

7. An apparatus in accordance with claim 6, wherein the articulated arm arrangement (30) includes a first articulated arm (32) and a second articulated arm (34) which are movable relative to one another.

8. An apparatus in accordance with claim 6, wherein the articulated arm arrangement (30) includes a first articulated arm (32) and a second articulated arm (34) which are pivotable relative to one another about a pivot axis extending parallel to the blade axis (M).

9. An apparatus in accordance with claim 7, wherein the second articulated arm (34) is pivotally connected to a fixed element (38) and the first articulated arm (32) is rotationally fixedly connected to the cover element (24).

10. An apparatus in accordance with claim 7, wherein the first articulated arm (32) is connected to the cover element (24) at two mutually spaced apart points (46, 47).

11. An apparatus in accordance with claim 7, wherein the first articulated arm (32) has two limbs (42, 43) which, starting from the second articulated arm (34), run apart, with one end of said limbs being connected to the cover element (24) in each case.

12. An apparatus in accordance with claim 11, wherein the two limbs (43, 43) are in particular at an acute angle (W) relative to one another.

13. An apparatus in accordance with claim 6, wherein the articulated arm arrangement (30) defines pivotal connection points (49, 50) which are essentially in a plane extending parallel to a cutting plane of the circular blade (10).

14. An apparatus in accordance with claim 1, wherein the holding apparatus includes a torsionally stiff coupling bar (60).

15. An apparatus in accordance with claim 14, wherein the coupling bar (60) is length variable.

16. An apparatus in accordance with claim 14, wherein the coupling bar (60) is rotationally fixedly in engagement with the cover element (24) and with a fixed element (38) by means of two connection joints (62, 64).

17. An apparatus in accordance with claim 14, wherein the coupling bar (50) is rotatingly drivable about its longitudinal axis to bring about a rotation of the cover element (24) at any desired speed.

18. An apparatus in accordance with claim 1, wherein the cover element (24) includes a disk which is coaxial to the circular blade (10) and which extends radially up to a region of a cutting edge (26) of the circular blade (10).

19. An apparatus in accordance with claim 1, wherein the cover element (24) is supported on the circular blade (10).

20. An apparatus in accordance with claim 1, wherein the cover element (24) is provided with elevated portions (59) at the side remote from the circular blade (10).

* * * * *

UNITED STATES PATENT AND TRADEMARK OFFICE

CERTIFICATE OF CORRECTION

PATENT NO. : 8,651,000 B2
APPLICATION NO. : 13/254620
DATED : February 18, 2014
INVENTOR(S) : Günther Weber It is certified that error appears in the above-identified patent and that said Letters Patent is hereby corrected as shown below:

Title Page, Column 2, item (56)

| | |
|---|---|
| Under Other Publications, Line 2 | After "Application", insert --No.-- |

In the Specifications:

| | |
|---|---|
| Column 3, Line 35 | After "position;", insert --and-- |
| Column 3, Line 38 | Delete "position;" and insert --position.-- |
| Column 4, Line 4 | Delete "14" and insert --44-- |
| Column 4, Line 23 | Delete "11" and insert --57-- |
| Column 4, Line 60 | Delete "50" and insert --60-- |
| Column 5, Line 13 | Delete "34" and insert --24-- |

In the Claims:

| | |
|---|---|
| Column 6, Line 34, Claim 12 | Delete "(43, 43)" and insert --(42, 43)-- |
| Column 6, Line 50, Claim 17 | Delete "(50)" and insert --(60)-- |

Signed and Sealed this
Twenty-seventh Day of May, 2014

Michelle K. Lee

Michelle K. Lee
*Deputy Director of the United States Patent and Trademark Office*